US008820345B2

(12) United States Patent
Gergaud et al.

(10) Patent No.: US 8,820,345 B2
(45) Date of Patent: Sep. 2, 2014

(54) CONSTRUCTION EQUIPMENT MACHINE WITH HYDRAULIC PRESSURE CONTROLLED SELECTING SYSTEM

(75) Inventors: Marc Gergaud, Vieu (FR); Philippe Charvieux, La Tour du Pin (FR)

(73) Assignee: Volvo Compact Equipment SAS, Belley (FR)

( * ) Notice: Subject to any disclaimer, the term of this patent is extended or adjusted under 35 U.S.C. 154(b) by 595 days.

(21) Appl. No.: 12/442,976

(22) PCT Filed: Oct. 12, 2006

(86) PCT No.: PCT/IB2006/003930

§ 371 (c)(1),
(2), (4) Date: Mar. 26, 2009

(87) PCT Pub. No.: WO2008/044094

PCT Pub. Date: Apr. 17, 2008

(65) Prior Publication Data

US 2010/0000617 A1 Jan. 7, 2010

(51) Int. Cl.

| | |
|---|---|
| ***G05D 11/00*** | (2006.01) |
| ***E02F 9/22*** | (2006.01) |
| ***E02F 9/12*** | (2006.01) |

(52) U.S. Cl.

CPC ..... *E02F 9/123* (2013.01); *E02F 9/2285* (2013.01); *E02F 9/128* (2013.01)

USPC ..... 137/118.06; 137/119.08

(58) Field of Classification Search

USPC ..... 137/118.01, 118.06, 119.01, 119.08

See application file for complete search history.

(56) References Cited

U.S. PATENT DOCUMENTS

| | | | | |
|---|---|---|---|---|
| 3,489,235 | A * | 1/1970 | Watson | 180/6.48 |
| 4,051,767 | A * | 10/1977 | Landsberg | 91/420 |
| 4,285,268 | A * | 8/1981 | Deckler | 91/517 |
| 4,308,884 | A | 1/1982 | Hoerger et al. | |
| 4,415,050 | A * | 11/1983 | Nishida et al. | 180/6.48 |
| 4,938,023 | A * | 7/1990 | Yoshino | 60/427 |
| 5,282,363 | A * | 2/1994 | Ogawa et al. | 60/420 |
| 5,293,746 | A | 3/1994 | Bianchetta | |
| 7,591,214 | B2 * | 9/2009 | Ando et al. | 91/431 |
| 2006/0218916 | A1 * | 10/2006 | Ando et al. | 60/473 |

FOREIGN PATENT DOCUMENTS

EP 1707691 A 10/2006

OTHER PUBLICATIONS

International Search Report for corresponding International Application PCT/IB2006/003930, 2007.

* cited by examiner

*Primary Examiner* — William McCalister
(74) *Attorney, Agent, or Firm* — WRB-IP LLP

(57) ABSTRACT

A construction equipment machine has a lower frame and an upper frame rotatably connected, the machine having at least one hydraulic pilot circuit comprising a primary hydraulic pilot line running from the upper frame to the lower frame through a rotary joint for controlling the operation of at least one hydraulic device located on the lower frame, including: a pressure regulating system capable of setting in the pilot circuit a pilot pressure having a value; a hydraulic pressure controlled selecting system which is located on the lower frame and is fed by the primary hydraulic pilot line, at least two independent secondary pilot lines located downstream of the pressure controlled selecting system, and wherein said hydraulic pressure controlled selecting system is capable of selectively and independently supply or not supply pressurized fluid to the independent secondary pilot lines, responsive to the value of the pilot pressure.

19 Claims, 5 Drawing Sheets

CONSTRUCTION EQUIPMENT MACHINE WITH HYDRAULIC PRESSURE CONTROLLED SELECTING SYSTEM

BACKGROUND AND SUMMARY

The invention relates to the field of construction equipment machines such as excavators, mini excavators, etc, and more particularly to such machines having an upper frame and a lower frame rotatably connected.

On FIG. 1 is depicted a conventional excavator 10. It comprises an upper frame carrying the excavator's superstructure 12 which comprises the driver's cabin 14 and an engine compartment 16. The upper frame carries the machine's main work equipment: a digging assembly 18. Typically, the digging assembly 18 can have boom 20 which is pivotably connected around a horizontal axis on the upper frame. The boom 20 can be lowered and lifted vertically by a boom cylinder 22. At the free end of the boom 20, an arm 24 may be pivotably connected around another horizontal axis, and it can be lowered and lifted by an arm cylinder 26. At the free end of the arm 24, a working tool, such as bucket 28, is pivotably connected around another horizontal axis and it can be pivoted relative to the arm 24 by a bucket cylinder 30.

The lower frame carries the undercarriage 32 of the machine 10, which comprises mainly the drivetrain 34 of the machine. In the example shown, the drive train is in the form of a pair of endless tracks but it could also be made of a set of wheels. In the example shown, the undercarriage 32 also comprises a working tool which is for example in the form of a front blade 36. For this blade to be perfectly convenient, it may desirable that it not only is capable of being lowered and lifted with respect to the undercarriage but also that it can be rotated around a horizontal axis and/or around a vertical axis. As it is well-known, the superstructure 12 of the machine can swivel around a vertical axis with respect to the undercarriage thanks to a suitable mechanical link between the upper frame and the lower frame, with the possibility of both frames rotating with respect to each other around a vertical axis. In many cases, the superstructure can swivel 360 degrees.

Most construction equipment machines use a hydraulic pressure system to operate the various working tools 28, 36 carried by the machine, as well as to operate the drive train 34. The hydraulic pressure system comprises usually a Diesel engine which drives at least one hydraulic pump which itself feeds pressurized fluid to various actuators through hydraulic circuits comprising hydraulic lines, distributors, valves, etc.

The major parts of the hydraulic pressure system are usually located on the upper frame of the machine. On the other hand, some of the tools carried by the machine may be located on the lower frame, such as the blade 36 mentioned above, not to mention the fact that the drivetrain, carried of course by the lower frame, usually comprises a hydraulic motor and possibly a hydraulic actuated gearbox.

Therefore, the machine is equipped with a rotary joint which provides hydraulic passages which permit the hydraulic lines to pass from the upper frame to the lower frame without being interrupted and without impeding the free swiveling of the two frames. Therefore, the rotary joint may have an upper part connected to the upper frame and a lower part connected to the lower frame. The upper and lower parts of the rotary joint have for example respective annular contact surfaces bearing one against the other, and at least one of the annular contact surfaces comprises an annular groove which is closed by either a corresponding annular groove on the other contact surface, or simply closed by that other contact surface. The groove(s) define an annular fluid flow path at the interface between the parts of the rotary joint. An upper portion of a hydraulic line (for example a hose or a pipe) is connected to the upper part of the rotary joint while a lower portion of the hydraulic line (made for example of another hose or pipe) is connected to the lower part of the rotary joint, both being fluidly connected to the annular groove. With this construction the upper and lower portions of the hydraulic line are fluidly connected one to the other irrespective of the angular position of the two parts of the rotary joint. Other types of rotary joints could be used in the context of the invention.

Of course, this means that the rotary joint needs to have one fluid flow path for each independent hydraulic line which is to be passed through the rotary joint. Therefore, one can easily understand that there is a strong motivation to keep the number of hydraulic lines to be passed through the rotary joint to a minimum.

Another constraint on construction equipment machines is at that they have to be able to work in a humid environment, up to the point where they should be capable of being fully operational even when the undercarriage is partly or totally submerged in water. One consequence is that it is most preferable not to have any electrical system running on the lower frame. Therefore it is well-known that any actuator located on the lower frame should not be piloted by an electrically piloted valve but rather by a hydraulically piloted valve. But then, given the fact that it is essential to keep the number of a hydraulic lines passing through the rotary joint to a minimum, this tends to limit the number of independently controlled devices which can be located on the lower frame.

It is desirable to provide a new conception of hydraulic circuitry which permits to have several independently controlled devices on the undercarriage, without necessitating the use of a very complex and expensive rotary joint. Moreover, it is desirable to make it possible to add new functionalities to an existing machine, as a retrofit, without having to change or modify the rotary joint.

According to an aspect of the invention, the invention provides for a construction equipment machine having a lower frame and an upper frame rotatably connected through a rotary joint, the machine having at least one hydraulic pilot circuit comprising a primary hydraulic pilot line running from the upper frame to the lower frame through said rotary joint for controlling, from the upper frame, the operation of at least one hydraulic device located on the lower frame, said hydraulic pilot circuit comprising: a pressure regulating system capable of setting in the pilot circuit a pilot pressure having a value, said pressure regulating system being located on the upper frame; a hydraulic pressure controlled selecting system which is located on the lower frame and is fed by said primary pilot line, at least two independent secondary pilot lines located downstream of said pressure controlled selecting system in said hydraulic pilot circuit, and wherein said hydraulic pressure controlled selecting system is capable of selectively and independently supply or not supply pressurized fluid to the at least two independent secondary pilot lines, responsive to said value of the pilot pressure.

BRIEF DESCRIPTION OF FIGURES

Other aspects and features of the invention will become apparent when reading the following detail the description of the invention with reference to the appended figures wherein.

DETAILED DESCRIPTION

Figure 1:
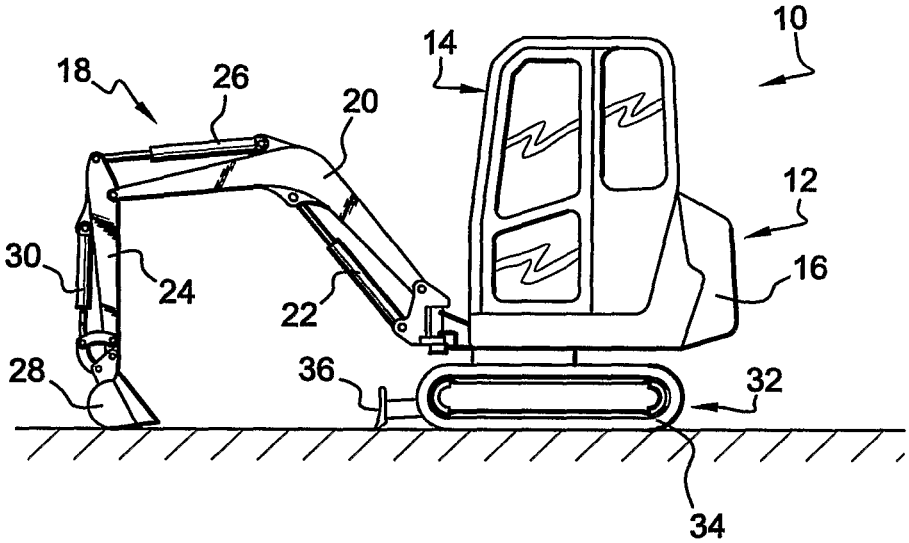
FIG. 1 is a general view of an excavator coming from the construction industry.
Figure 2:
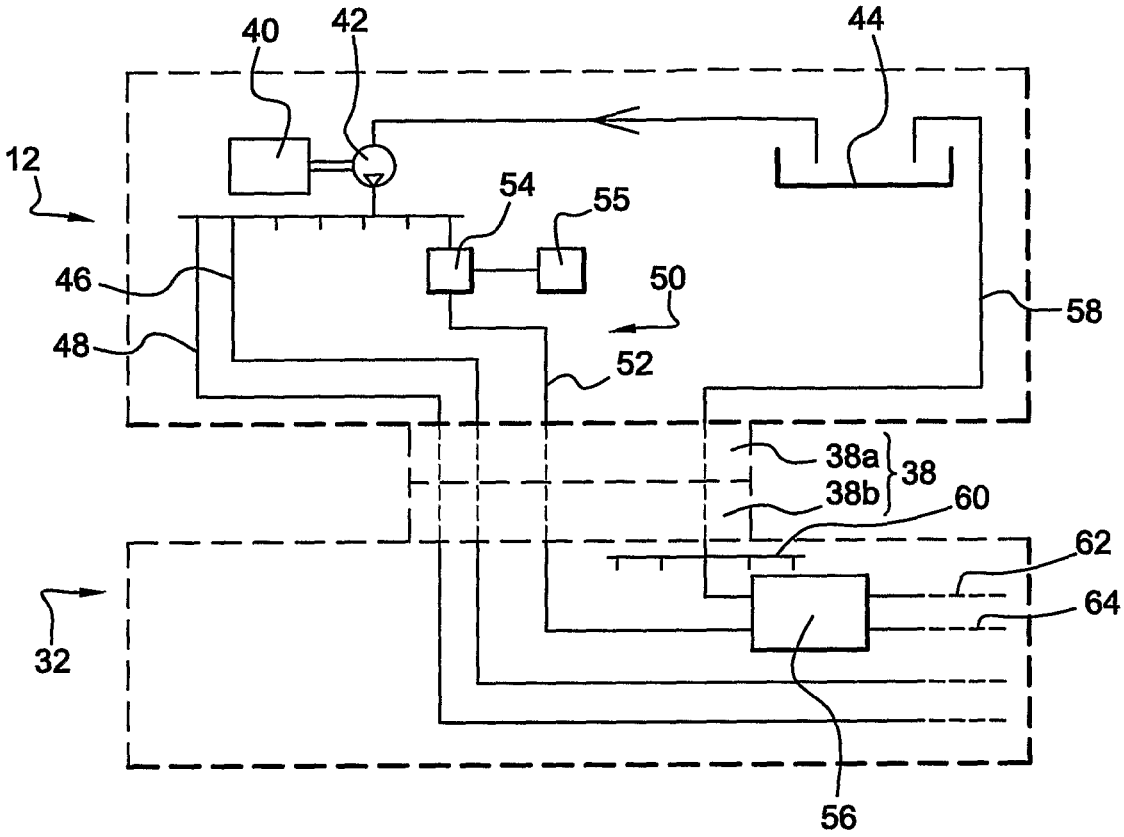
FIG. 2 is a diagrammatic view showing some of the components of the excavator of figure one.

On FIG. 2, one can see the very diagrammatic picture of some of the components of a hydraulic pressure system which operates the machine. On this diagram, the upper box represents the superstructure 12 of the machine and the lower box represents the undercarriage 32 of the machine. Both are connected through the rotary joint 38 having an upper part 38*a* and a lower part 38*b*. The hydraulic system comprises an engine 40 which drives a hydraulic pump 42. An oil tank 44 is connected to the oil pump 42, the output of which is connected to various hydraulic lines. Some of these hydraulic lines will feed the devices located on the upper frame of the machine while other lines will feed devices located on the lower frame of the machine. For example, two hydraulic lines 46, 48 are shown which go through the rotary joint 38 down to the undercarriage 32. Those hydraulic lines 46, 48 may for example be hydraulic power lines feeding two hydraulic motors for the drive train 34. Other hydraulic lines are of a different nature in that they are used as pilot lines, which means that they are used to transmit information and not only energy and power.

On FIG. 2 is shown one hydraulic pilot circuit 50 comprising such a hydraulic pilot line 52. Thanks to the invention, the hydraulic pilot circuit 50 is capable of selectively and independently control at least two separate devices which are located on the lower carriage of the machine. Hydraulic pilot circuit 50 comprises a pressure regulating system 54 which the driver of the machine can control through a human machine interface 55 which can for example comprise knobs and/or buttons and/or levers etc. The pressure regulating system 54 can set in the hydraulic pilot line 52 a selected pressure, which will be hereinafter called pilot pressure, having a determined value, based on an instruction given by the driver through the human machine interface 55. Preferably, said pilot pressure will be set to one of a predetermined set of values. The pressure regulating system can be of the continuous type (such as in the form of a proportional throttle valve), so that pressure varies continuously between predetermined values of the set, or of the discrete type, so that the pilot pressure value can only be one of those predetermined values in the set.

A primary portion of the hydraulic pilot line 52, after passing through the rotary joint 38, connects the pressure regulating system 54 to the input of a hydraulic pressure controlled selecting system 56. The hydraulic pressure controlled selecting system 56 is also connected to the tank 44 of the hydraulic pressure system through a return line 58 which can be for example a common return line for several devices. Indeed, it is a possibility that all these devices are connected for example to a common return line 58 through a return manifold 60. Advantageously, all the devices located on the undercarriage 32 and which need to be connected to the oil tank 44 through a return line will be connected to the common manifold 60, located itself also on the undercarriage 32 so that is only one the return line 58 needs to be passed through the rotary joint 38. It will here be assumed that the hydraulic pressures in the return manifold 60 and in the return line 58 are near to zero.

As can be seen on FIG. 2, a first and a second secondary hydraulic pilot lines 62, 64 are connected to the outputs of the hydraulic pressure controlled selecting system 56. In the example shown, there are only two such secondary hydraulic pilot lines but, as it will be explained below, more of them could be provided.

According to the invention, the hydraulic pilot circuit 50 is designed so that, with only one primary hydraulic pilot line 52 going through the rotary joint 38, a selected pilot pressure PP can be independently and selectively supplied or not supplied to the secondary hydraulic pilot lines, responsive to the value of the pilot pressure PP.

Figure 3:
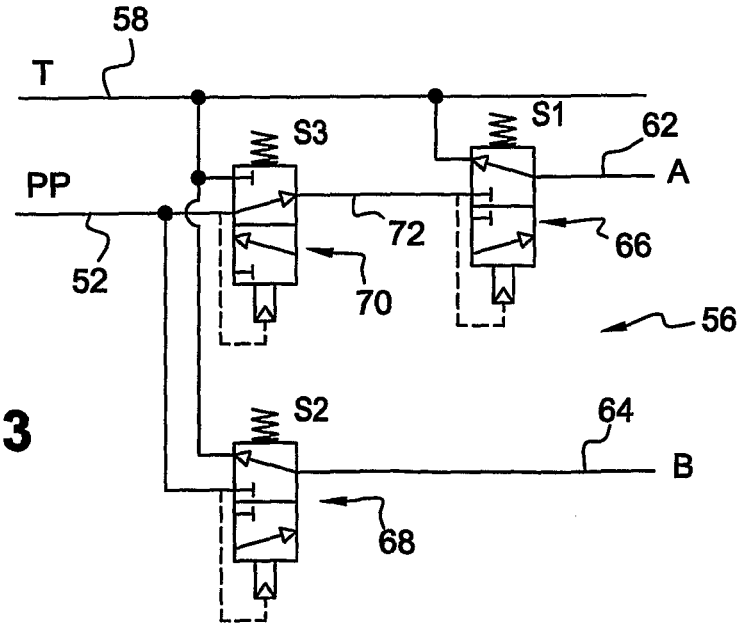
FIG. 3 is a schematic view of a first embodiment of a hydraulic pressure controlled selecting system acting as a four state selector.

A first embodiment of a pressure controlled hydraulic selecting system 56 is shown on the FIG. 3. This first embodiment is a four state selecting system for selectively and independently supplying or not supplying pressure to two secondary pilot lines 62, 64. In this embodiment, the hydraulic pressure controlled selecting system 56 comprises a first, a second, and a third pressure controlled switch valves 66, 68, 70, each having respectively a switch pressure threshold value S1, S2, S3. The switch pressure threshold values S1, S2, S3 are distinct and S1 is lower than S2 which is lower than S3. For example, S1 could be approximately equal to 10 bars, S2 approximately equal to 20 bars and S3 approximately equal to 30 bars. The three pressure controlled switch valves 66, 68, 70 are each of a type such that they can switch between an allowing or blocking state for the passage of an input pressure through the valve, depending on the value of said input pressure compared to the corresponding switch pressure threshold value. Different type of valves could be used, including a combination of valves, said combination achieving the same function. According to this embodiment, each of these valves is for example a three-way valve (i.e. having three ports, but other type of valves may be used) with two positions, a third port of the valve being connected to either one or to the other of a first or a second port depending on the position of the valve (i.e. depending on the switch state of the valve), and wherein the one of the first or second port which, in a given in position, is not connected to the third port, is blocked. Each valve has a control port which is fed with a hydraulic control pressure, the value of which is compared to the switch pressure threshold value to determine the state or position of the valve. In this embodiment, the control port is always connected to the first port.

In this first example, the second valve 68 and the third valve 70 are arranged in a parallel configuration and each have a first port which is fed with the pilot pressure PP by the primary hydraulic pilot line 52, and a second port which is connected to the return line 58. The control port of each of these two valves is also connected to the primary hydraulic pilot line 52 so that the pilot pressure PP in that pilot line 52 controls the switching of the second and the third valves. In the absence of any control pressure (for example if pilot pressure PP is equal to zero), the second valve 68 is in a position where its first input port is blocked while its second port is in communication with the third port. To the contrary, in the absence of any control pressure, the third valve 70 is in a position where its first port is in communication with its third port, while its second port is blocked. When the control pressure is above its switch pressure threshold value S2, the second valve is in a position where its first port is in communication with its third ports while the second port is blocked.

To the contrary, when the control pressure is above its switch pressure threshold value S3, the third valve is in a position where its first port is blocked while its second port is in communication with its third port. In other words, second valve 68 is of the "normally closed" type, while the third valve 70 is of the "normally open" type. As can be seen on the figure, the third port of the second valve is connected to the second secondary pilot lines 64. The third port of the third valve 70 is connected to an intermediate line 72 which feeds the first port of the first valve 66. The first valve 66 has the same the configuration as the second valve 68, with, in the absence of any control pressure, its second port connected to return line 58 and with its first port being blocked (i.e. "normally closed"). The control port of the first valve 66 is connected to the intermediate line 72. The first secondary pilot line 62 is connected to the third port of the first valve 66.

The four states of this pressure selecting system 56 will now be described depending on the value of the pilot pressure PP which is set in the primary hydraulic pilot line 52 by the pressure regulating system 54 depending on the input from the machine's driver.

When pilot pressure PP is equal to a value PO which is inferior to S1, for example equal to zero, the pressure controlled selecting system 56 is exactly in the configuration shown in FIG. 3. The second secondary pilot line 64 is therefore set in communication with the return line 58 by the second valve 68. The intermediate line 72 is set in communication with the primary hydraulic pilot line 52 by the third valve 70. Therefore, pressure in the intermediate line 72 is equal to the pilot pressure PP. PP being inferior to S1, the first valve 66 is in a position where the first secondary pilot line 62 is set in communication with the return line 58. Therefore, the pressure PA in the first secondary line 62 and the pressure PB in the second secondary line 64 are both equal to zero.

A second state of the system occurs when pilot pressure PP is equal to a value P1 which is higher than S1 but lower than S2. P1 being inferior to S2, the second valve 68 does not switch so that pressure PB remains at zero, but pressure P1 being higher than S1, the first valve 66 will switch, and the first secondary pilot line 62 is set in communication with the intermediate line 72. Therefore, pressure PA in the secondary pilot line 62 will be equal to the pilot pressure, the value of which is then P1.

If we now assume that pilot pressure PP is equal to a value P2 which is higher than S2 but lower than S3, then the first and the third valves will keep the configuration described for the preceding state, pressure PA staying equal to the pilot pressure PP which has now a value of P2. To the contrary, the second valve 68 will switch, setting its third port in communication with the primary hydraulic pilot line 52, so that pressure PB in the secondary pilot line 64 is also set to the same value as PP, which is then PZ.

Finally, if we now assume that pilot pressure PP is equal to a value P3 which is higher than S3, then the second valve 68 will keep the configuration described for the preceding state, pressure PB staying equal to the pilot pressure PP which has now a value of P3. To the contrary, the third valve 70 will switch so that intermediate line 72 is set in communication with return line 58. Therefore, the pressure in that intermediate line 72 will drop to zero, causing the control pressure of the first valve 66 to drop below its switch pressure threshold value S1. This in turn will cause the switching back of the first valve 66 to its initial position where the first secondary pilot line 62 is in communication with return line 58. Pressure PA will therefore also drop back to zero.

According to the above description, the pressure selecting system has four states of pressure on its two secondary pilot lines 62, 64, these four states being as set forth in the following table:

| Value of Pilot Pressure PP | Value of pressure PA | Value of Pressure PB |
|---|---|---|
| P0 | 0 | 0 |
| P1 | P1 | 0 |
| P2 | P2 | P2 |
| P3 | 0 | P3 |

(With 0 < P0 < S1 < P1 < S2 < P2 < S3 < P3)

Therefore, these two secondary pilot lines 62, 64 can be used to independently and selectively control two devices connected respectively to the first and to the second secondary pilot lines.

Figure 4:
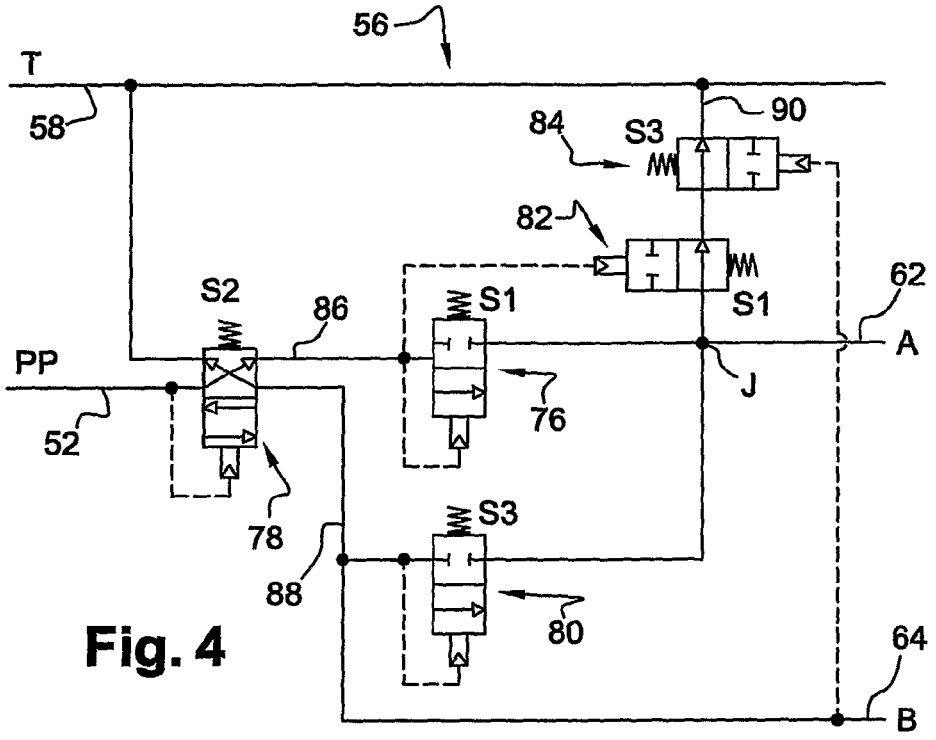
FIG. 4 is a view similar to FIG. 3 showing a second embodiment of a four state selector.

In FIG. 4 is a shown a second embodiment of a hydraulic pressure controlled selecting system 56 which, just as the first one, is a four states selecting system. As in the first embodiment, the hydraulic pressure controlled selecting system comprises a first, a second and a third main pressure controlled switch valves 76, 78, 80, each having respectively a switch pressure threshold value S1, S2, S3. The switch pressure threshold values S1, S2, S3 are distinct and S1 is lower than S2 which is lower than S3. This second embodiment also comprises two auxiliary pressure controlled switch valves 82, 84, the position and the role of which will be described below. These five valves are pressure controlled switch valves, each of the type such that they can switch between an allowing or blocking state for the passage of an input pressure through the valve, depending on the value of said input pressure compared to its switch pressure threshold value.

In this embodiment, the first and the third main valves 76, 80 are two-way valves with one first port and one second port, with two positions or states, allowing or blocking the communication between the two ports. The control pressure of these two valves is the pressure fed to the first port, and they are in their blocking state when the control pressure is below their switch pressure threshold value. In this embodiment, the second main valve 78 is a four-way valve having a first port connected to the primary hydraulic pilot line 52, a second port connected to return line 58, a third port connected to a first intermediate line 86, and a fourth port connected to a second intermediate line 88. The control port of this second main valve 78 is connected to the primary pilot line 52 so that the control pressure is equal to the pilot pressure PP. This second main valve 78 is a two position (or two states) valve wherein, in a first position, the first port is set in communication with the third port and the second port is set in communication with the fourth port. In a second position, the communications are inverted. Therefore as can be seen in FIG. 4, when pilot pressure PP is inferior to S2, first intermediate line 86 is connected to the primary pilot line 52 and the second intermediate line 88 is connected to the return line 58. When pressure PP exceeds S2, connections are inverted. The first intermediate line 86 is connected to the first port of the first main valve 76.

The second intermediate line 88 is connected to the first port of the third main valve 80. The second ports of the first and third main valves are joined at a junction point J. This junction point J is connected to the first secondary pilot line 62, but it is also connected to the return line 58 through a parallel branch return line 90.

The first and second auxiliary valves 82, 84 are set in series on that branch return line 90. The first and second auxiliary valves 82, 84 are two-way, two positions, pressure controlled switch valves which allow or block the flow of fluid in the branch return line, both being normally open. The first auxiliary valve 82 as a switch pressure threshold value S1 equal to that of the first main valve 76 and its control port is connected to the first intermediate line 86. The second auxiliary valve 84 has a switch pressure threshold value S3 equal to that of the third main valve 80 and its control port is connected to the second intermediate line 88. Basically, the auxiliary valves 82, 84 control the connection between the junction point J and the return line, so that when both of them are open, no pressure can build up in the first secondary pilot line 62.

The second secondary pilot line 64 is connected directly to the second intermediate line 88.

The exact functioning of this pressure regulating system will not be described in detail. Nevertheless, one can see that the second main valve 78 will direct the pilot pressure PP either to the first intermediate line 86, if PP is lower than S2, or to the second intermediate line 88 if PP is higher than S2. In the first case, pressure PB in the second secondary pilot line 64 will always be zero, while the in the second case, pressure PB will always be equal to the pilot pressure PP.

If PP is lower than S1, then the first 76 and the third 80 main valves will remain closed (i.e. in their blocking state), while both auxiliary valves 82, 84 will be in their allowing (open) state. PA will therefore be zero.

If PP has a value P1 which is lower than S2 but higher than S1, then the first main valve will switch to its allowing state. The first auxiliary valve 82 will be switched to its blocking state, thereby shutting the branch return line 90, so that pressure PA in the first secondary line 62 may build up and is then equal to P1.

If PP has a value P2 which is higher than S2 but lower than S3, the input of the first main valve 76 will be connected to the return line 58, and that first main valve will remain closed, while the third main valve will also remained closed. At the same time, both auxiliary valves will remain open, so that pressure PA will be zero. Pressure PB will then be equal to P2.

If PP has a value P3 which is higher than S3, the third main valve 80 will switch to its open position and the second auxiliary valve 84 will switch to its blocking position so that pressure PA will be equal to P3, just as pressure PB.

The four states of this second embodiment of a pressure regulating system can therefore be summarized as in the following table:

| Value of Pilot Pressure PP | Value of pressure PA | Value of Pressure PB |
|---|---|---|
| P0 | 0 | 0 |
| P1 | P1 | 0 |
| P2 | 0 | P2 |
| P3 | P3 | P3 |

(With P0 < S1 < P1 < S2 < P2 < S3 < P3)

Figure 5:
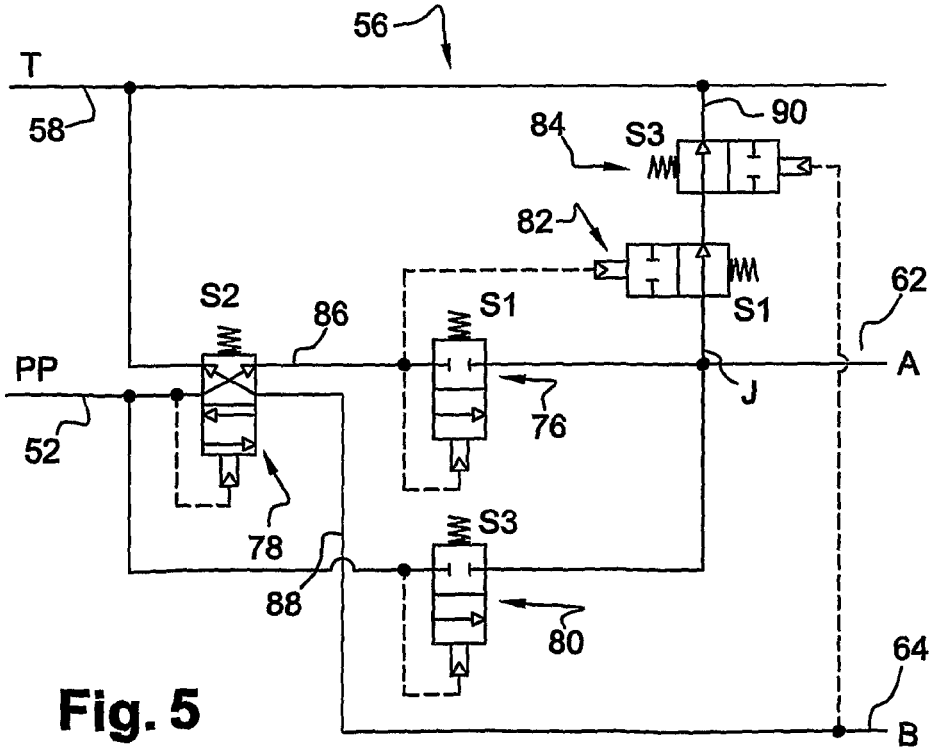
FIG. 5 shows a variant of the selector of FIG. 4.

The third embodiment of a pressure selecting system which is illustrated on FIG. 5 is only a slight variation of the embodiment of FIG. 4. Indeed the only difference is that the third main valve 80 has its input port which is connected directly to the primary pilot line 52, in parallel with the first port of the second main valve 78.

In this embodiment, the second intermediate line 88 and the second secondary pilot line 64 are one and only line. The four states of this third embodiment are the same as those summarized in the table relating to the second embodiment.

Figure 6:
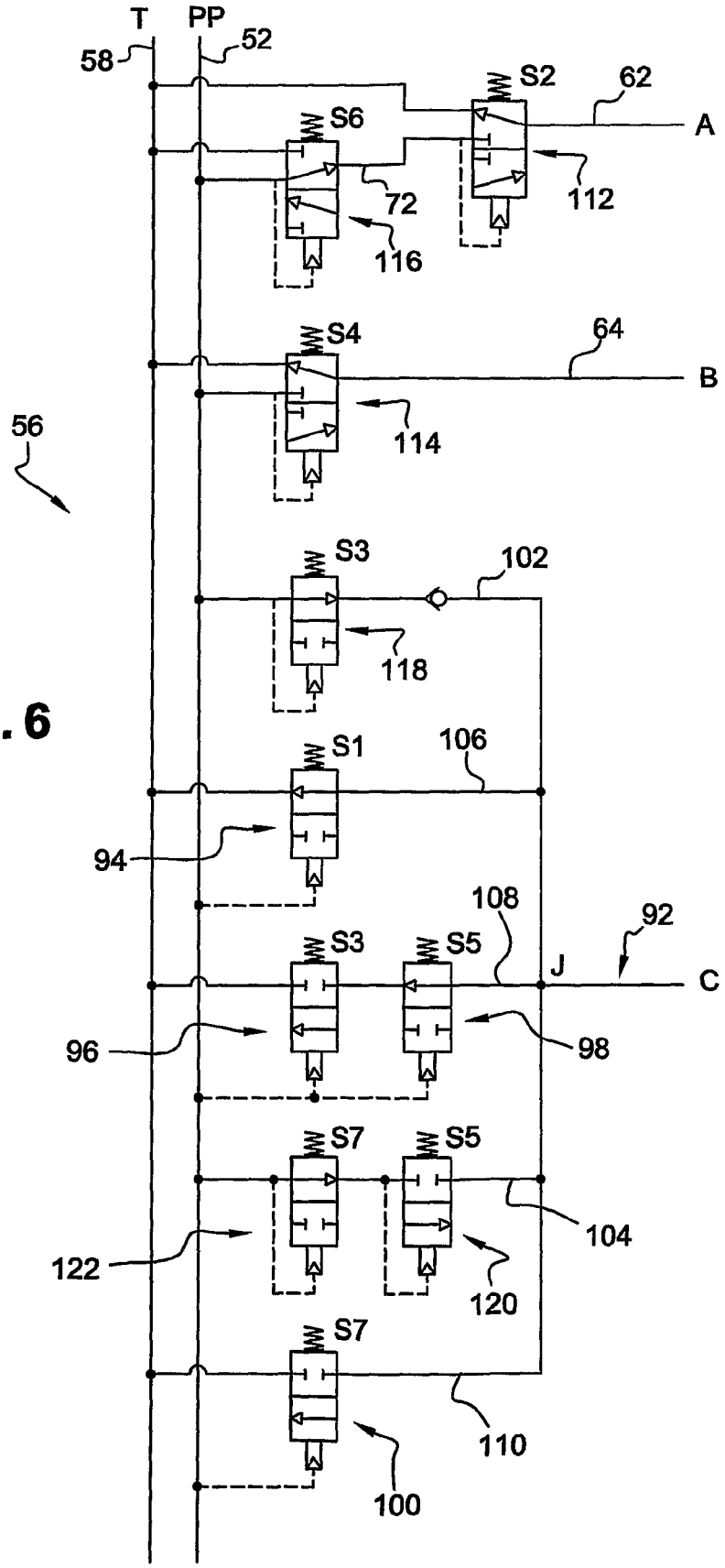
FIG. 6 is a schematic view of a hydraulic pressure controlled selecting system acting as an eight state selector.

On FIG. 6, is shown an embodiment of a pressure regulating system which is designed so as to be able to independently and selectively supply or not supply a pilot pressure to one of three independent secondary pilot lines 62, 64, 92, responsive to the value of the pilot pressure PP. Therefore, this embodiment is an eight state selector having six main valves 112, 114, 116, 118, 120, 122, each having a switch pressure threshold values, respectively S2, S4, S6, S3, S5, S7, and four auxiliary valves 94, 96, 98, 100, each having a switch pressure threshold values, respectively S1, S3, S5 and 87, with S1<S2<S3<S4<S5<S6<S7. All pressure controlled switch valves.

The mains valves indicated 112, 114, 116 are exactly in the same set up as respectively the first, second and third valves of the first embodiment of FIG. 3, so that they will not be described any further since their operation is as described in relation to FIG. 3, with only the switching values being different.

As it can be seen on FIG. 6, the third secondary pilot line 92 is connected to the junction point J. Junction point J is also the junction point for five branch lines. Two of these branch lines are pressure feeding lines capable of bringing the pilot pressure PP up to the junction point J while the three other branch lines are bleeding lines capable of connecting junction point J to the return line 58. Main valve 118 is mounted on a first feeding branch line 102 together with a non-return valve so that pilot pressure will be fed to junction point J as long as pilot pressure PP is lower than S3. Main valves 120 and 122 are mounted in series on a second feeding branch line 104 so that pilot pressure PP in the primary pilot line 52 is fed to the junction point J only if pilot pressure exceeds S5 but remains below S7.

A first bleeding branch line 106 is equipped with a first auxiliary valve 94 having a switch pressure threshold value S1 lower than S2, so that this bleeding line is active as long as pilot pressure PP remains below S1 and is blocked when pilot pressure PP is over S1. A second bleeding branch line 108 is equipped with two auxiliary valves 96, 98 having respectively a switch pressure threshold value equal to S3 and S5, so that this bleeding line is active as long as the pilot pressure in the primary pilot line 52 is comprised between the values of S3 and S5. A third bleeding branch line 110 is equipped with the fourth auxiliary valve 100 which has a switch pressure threshold value equal to S7, so that the bleeding line is active only when the pilot pressure in the primary pilot line is over S7.

The eight states of this fourth embodiment of a pressure regulating system can therefore be summarized as in the following table:

| Value of Pilot Pressure PP | Value of PA | Value of PB | Value of PC |
|---|---|---|---|
| P0 | 0 | 0 | 0 |
| P1 | 0 | 0 | P1 |
| P2 | P2 | 0 | P2 |
| P3 | P3 | 0 | 0 |
| P4 | P4 | P4 | 0 |
| P5 | P5 | P5 | P5 |
| P6 | 0 | P6 | P6 |
| P7 | 0 | P7 | 0 |

(With P0 < S1 < P1 < S2 < P2 < S3 < P3 < S4 < P4 < S5 < P5 < S6 < P6 < S7 < P7)

As one can understand from the above, the hydraulic pressure controlled pressure selecting systems have the important feature that they are purely hydraulically controlled, that is they do not require any electrical signal. They act as decoding units capable of translating one analog information (in the form of a pilot pressure having different values) into two or three (or even more) binary pieces of information which can be used to control the actuation of any device located downstream. In the context of a construction equipment machine, this means that the hydraulic circuit described herein requires only one hydraulic line trough the rotary joint to control independently and selectively various devices, or several functions on one device.

For example, each secondary pilot line could be used to feed the control port of a switch valve used for example to block or allow the passage of fluid in a power line; or to feed directly a cylinder to engage or disengage any kind of device, such device being for example either a control device for another device or directly a tool which would for example have only to positions, such as a working position and a non-working position.

Figure 7:
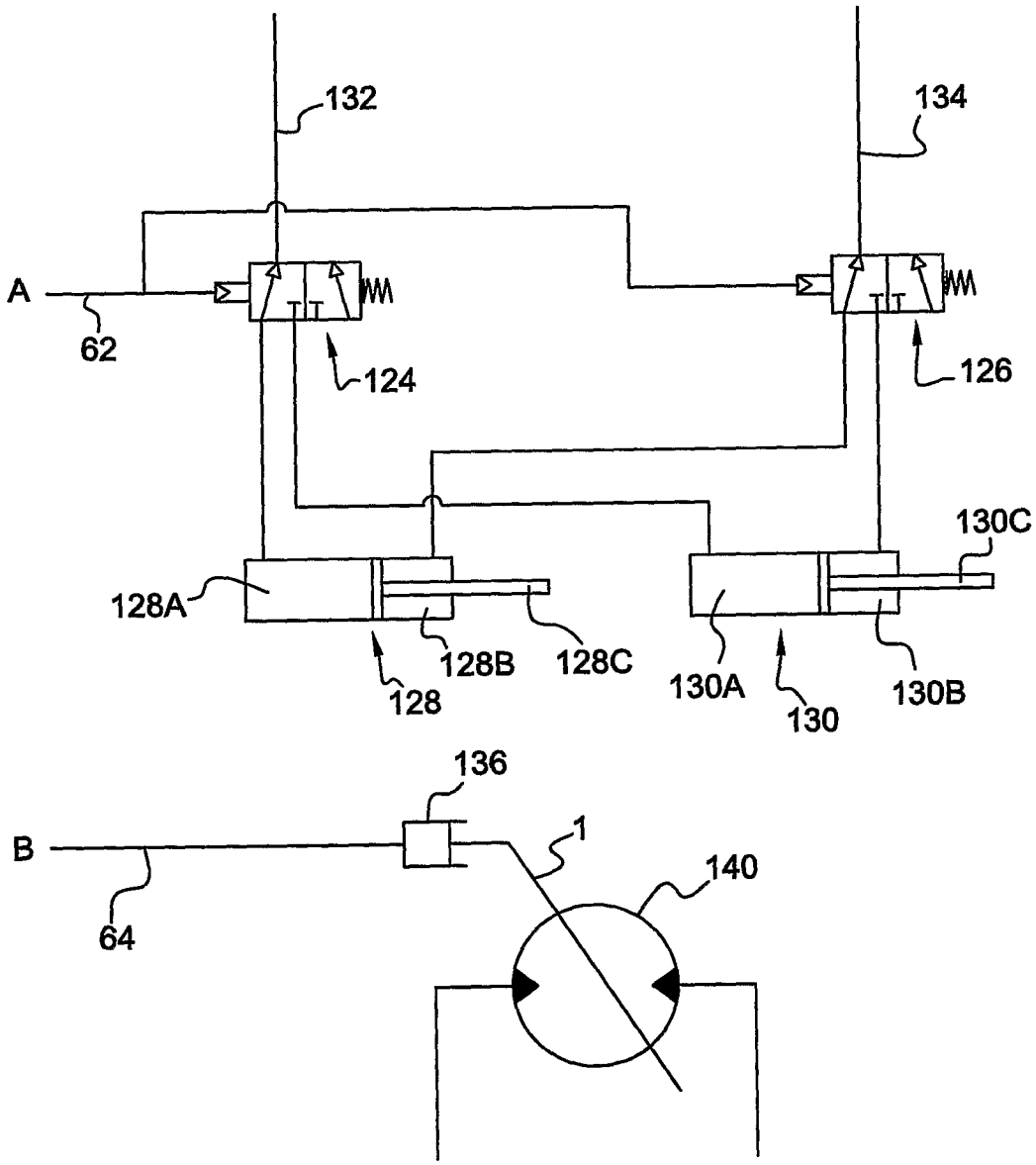
FIG. 7 is a schematic view of a hydraulic pressure controlled selecting system acting as a four state selector.

On FIG. 7 is shown an embodiment of what kind of devices could be piloted through a four state selector according to the invention. For example, first secondary pilot line 62 could be used to drive a first and a second switch valve 124, 126 which are crossed branched on two two-way actuators 128, 130. Each pilot valve 124, 126 is a three-way switch valve having a first port which is connected (by two respective input/output lines 132, 134) alternatively to a power pressure source or to a tank, for example through a non depicted switch valve. Each actuator 128, 130 has a first chamber 128A, 130A, a second chamber 128B, 130B, and a piston 128C1 130C which is displaced according to the pressure difference in the two chambers. The first pilot valve 124 has two ports respectively connected to the first chamber 128A, 130A of respectively the first and the second actuator. The second pilot valve 126 has two ports respectively connected to the second chamber 128B, 130B of respectively the first and the second actuator. Through the two pilot valves 126, 128, a first input/output line 132 is connected either to first chamber of first actuator (while at the same the second input/output line 134 is connected to the second chamber of the same first actuator), or to the first chamber of second actuator (while at the same the second input/output line 134 is connected to the second chamber of the same second actuator). Therefore, with this arrangement, one understands that, depending on whether there is a pressure in first secondary line 62 or not, the first actuator 128 will be active or the second 130 will be active.

At the same time, the second secondary pilot line 64 is used to drive, through a hydraulic actuator 136, a speed changing mechanism 138 for a hydraulic motor 140 so as to set either a low speed or a high speed.

Thanks to the four sate selector according to the invention, one primary pilot line is enough to selectively and independently operate the actuator selector mechanism 124, 126, and the speed changing mechanism 138.

The invention claimed is:

1. A construction equipment machine, comprising:

a lower frame and an upper frame rotatably connected, and a hydraulic pilot circuit comprising a single hydraulic pilot line running from the upper frame to the lower frame through a rotary joint for controlling, from the upper frame, the operation of at least one hydraulic device located on the lower frame, the hydraulic pilot circuit comprising:

a pressure regulating system capable of setting in the pilot circuit a pilot pressure having a value, the pressure regulating system being located on the upper frame;

a hydraulic pressure controlled selecting system which is located on the lower frame and is fed by the hydraulic pilot line, at least two independent secondary pilot lines located downstream of the pressure controlled selecting system in the hydraulic pilot circuit, and wherein the hydraulic pressure controlled selecting system is arranged to selectively and independently supply or not supply pressurized fluid from the single hydraulic pilot line directly through the hydraulic pressure controlled selecting system to the at least two independent secondary pilot lines and thereby selectively supply pressurized fluid to at least three of none, only one, more than one but less than all, and all of the secondary pilot lines in response to the value of the pilot pressure.

2. A machine according to claim 1, wherein the hydraulic pressure controlled selecting system is a purely hydraulic controlled selector.

3. A machine according to claim 2, wherein the hydraulic pressure controlled selecting system is a four state selector for selectively and independently supplying or not supplying the two secondary pilot lines.

4. A machine according to claim 2, wherein the hydraulic pressure controlled selecting system is an eight state selector for selectively and independently supplying or not supplying three secondary pilot lines.

5. A machine according to claim 4, wherein the hydraulic pressure controlled selecting system comprises ten pressure controlled switch valves each having respectively a switch pressure threshold value.

6. A machine according to claim 1, wherein the hydraulic pressure controlled selecting system comprises a plurality of two position pressure controlled switch valves.

7. A machine according to claim 6, wherein an output of the hydraulic pressure controlled selecting system comprises a pressure which is equal to the pilot pressure.

8. A machine according to claim 1, wherein pressurized fluid supplied to any of the at least two secondary pilot lines through the hydraulical pressure controlled selecting system and pressurized fluid in the hydraulic pilot line are at a same pressure.

9. A construction equipment machine, comprising:

a lower frame and an upper frame rotatably connected, and a hydraulic pilot circuit comprising a single hydraulic pilot line running from the upper frame to the lower frame through a rotary joint for controlling, from the upper frame, the operation of at least one hydraulic device located on the lower frame, the hydraulic pilot circuit comprising:

a pressure regulating system capable of setting in the pilot circuit a pilot pressure having a value, the pressure regulating system being located on the upper frame;

a hydraulic pressure controlled selecting system which is located on the lower frame and is fed by the hydraulic pilot line, at least two independent secondary pilot lines located downstream of the pressure controlled selecting system in the hydraulic pilot circuit, wherein the hydraulic pressure controlled selecting system is arranged to selectively and independently supply or not supply pressurized fluid from the single hydraulic pilot line directly through the hydraulic pressure controlled selecting system to the at least two independent secondary pilot lines, responsive to the value of the pilot pressure, wherein the hydraulic pressure controlled selecting system is a purely hydraulic controlled selector, wherein the hydraulic pressure controlled selecting system is a four state selector for selectively and independently supplying or not supplying the two secondary pilot lines, wherein the at least two secondary pilot lines comprises two secondary pilot lines, and:

for a first value, or range of values, of the pilot pressure, both of the two secondary pilot lines are not fed with pressurized fluid;

for a second value, or range of values, of the pilot pressure, only one of the two secondary pilot lines is fed with pressurized fluid;

for a third value, or range of values of the pilot pressure, only the other of the two secondary pilot lines is fed with pressurized fluid;

for a fourth value, or range of values, of the pilot pressure, both of the two secondary pilot lines are fed with pressurized fluid.

10. A machine according to claim 9, wherein the hydraulic pressure controlled selector comprises a first, a second and third pressure controlled switch valves each having respectively a switch pressure threshold value.

11. A machine according to claim 10, wherein the three pressure controlled switch valves each have a distinct switch pressure threshold value so that the first of the three valves has a switch pressure threshold value which is lower than that of the second of the three valves, the switch pressure threshold of the second valve being in turn lower than that of the third of the three valves.

12. A machine according to claim 11, wherein the three pressure controlled switch valves are each of a type such that they switch between an allowing or blocking state for the passage of an input pressure through the valve, depending on the value of the input pressure compared to its respective switch pressure threshold value.

13. A machine according to claim 12, wherein the hydraulic pressure controlled selecting system feeds the pilot pressure in parallel to the second and the third pressure controlled switch valves, wherein the third pressure switch controlled valve is normally open when pilot pressure is lower than its switch pressure threshold value, and wherein the first pressure switch controlled valve is located downstream of the third valve and is normally closed when pilot pressure is lower than its switch pressure threshold value.

14. A machine according to claim 13, wherein a first of the secondary pilot lines is connected to an output of the first valve, and wherein a second of the secondary pilot lines is connected to an output of the second valve.

15. A machine according to claim 10, wherein:

the pilot pressure is fed to the second pressure controlled switch valve which is of a type which may switch an input pressure either to a first intermediate line or to a second intermediate line depending on the input pressure, wherein the first and third pressure controlled switch valves are each of a type such that they switch between an allowing or blocking state thr the S passage of the a pressure through the valve, depending on the value of the pressure compared to the switch pressure threshold value, wherein the first and third pressure switch controlled valve are in their blocking state when a main input pressure is lower than their respective switch pressure threshold values, wherein the first intermediate line feeds the first valve, a first of the secondary pilot lines being connected to an output of the first valve, wherein the second intermediate line is connected to the second of the secondary pilot lines, and wherein the first secondary pilot line is also connected to an output of the third valve.

16. A machine according to claim 15, wherein the third valve is fed by the second intermediate line in parallel to the second secondary pilot line.

17. A machine according to claim 15, wherein the third valve is fed directly with the pilot pressure in parallel with the second valve.

18. A construction equipment machine, comprising:

a lower frame and an upper frame rotatably connected, and a hydraulic pilot circuit comprising a single hydraulic pilot line running from the upper frame to the lower frame through a rotary joint for controlling, from the upper frame, the operation of at least one hydraulic device located on the lower frame, the hydraulic pilot circuit comprising:

a pressure regulating system capable of setting in the pilot circuit a pilot pressure having a value, the pressure regulating system being located on the upper frame;

a hydraulic pressure controlled selecting system which is located on the lower frame and is fed by the hydraulic pilot line, at least two independent secondary pilot lines located downstream of the pressure controlled selecting system in the hydraulic pilot circuit, wherein the hydraulic pressure controlled selecting system is arranged to selectively and independently supply or not supply pressurized fluid from the single hydraulic pilot line directly through the hydraulic pressure controlled selecting system to the at least two independent secondary pilot lines, responsive to the value of the pilot pressure, wherein the hydraulic pressure controlled selecting system comprises a plurality of two position pressure controlled switch valves, wherein the two position switch valves are arranged to switch between an allowing or blocking state for the passage of an input pressure through the valve, depending on the value of the input pressure compared to its respective switch pressure threshold value.

19. A construction equipment machine, comprising:

a lower frame and an upper frame rotatably connected, and a hydraulic pilot circuit comprising a single hydraulic pilot line running from the upper frame to the lower frame through a rotary joint for controlling, from the upper frame, the operation of at least one hydraulic device located on the lower frame, the hydraulic pilot circuit comprising:

a pressure regulating system capable of setting in the pilot circuit a pilot pressure having a value, the pressure regulating system being located on the upper frame;

a hydraulic pressure controlled selecting system which is located on the lower frame and is fed by the hydraulic pilot line, at least two independent secondary pilot lines located downstream of the pressure controlled selecting system in the hydraulic pilot circuit, wherein the hydraulic pressure controlled selecting system is arranged to selectively and independently supply or not supply pressurized fluid from the single hydraulic pilot line directly through the hydraulic pressure controlled selecting system to the at least two independent secondary pilot lines, responsive to the value of the pilot pressure, wherein the hydraulic pressure controlled selecting system comprises a plurality of two position pressure controlled switch valves, wherein the two position switch valves are controlled by a control pressure which is the pilot pressure.

* * * * *